US010123577B2

(12) United States Patent
Larnard

(10) Patent No.: US 10,123,577 B2
(45) Date of Patent: Nov. 13, 2018

(54) NURSING COVER AND INFINITY SCARF

(71) Applicant: LindyJo Larnard, Livonia, NY (US)

(72) Inventor: LindyJo Larnard, Livonia, NY (US)

( * ) Notice: Subject to any disclaimer, the term of this patent is extended or adjusted under 35 U.S.C. 154(b) by 88 days.

(21) Appl. No.: 15/375,110

(22) Filed: Dec. 11, 2016

(65) Prior Publication Data

US 2017/0164666 A1 Jun. 15, 2017

Related U.S. Application Data

(60) Provisional application No. 62/266,542, filed on Dec. 11, 2015.

(51) Int. Cl.

| | |
|---|---|
| ***A41D 1/215*** | (2018.01) |
| ***A41D 15/00*** | (2006.01) |
| ***A41D 27/00*** | (2006.01) |
| *A41D 23/00* | (2006.01) |
| *A41D 3/08* | (2006.01) |

(52) U.S. Cl.

CPC ..... *A41D 15/00* (2013.01); *A41D 1/215* (2018.01); *A41D 27/00* (2013.01); *A41D 3/08* (2013.01); *A41D 23/00* (2013.01)

(58) Field of Classification Search

CPC ..... A41D 1/215; A41D 15/007; B62B 9/142; A41C 3/08; A41C 3/10

USPC ..... 2/204, 207, 104, 91

See application file for complete search history.

(56) References Cited

U.S. PATENT DOCUMENTS

| | | | | |
|---|---|---|---|---|
| 677,010 | A * | 6/1901 | Ziller | A41B 13/103 2/49.2 |
| 3,144,660 | A * | 8/1964 | Portaro | 2/88 |
| 4,706,303 | A * | 11/1987 | Van Gompel | A41B 13/10 2/49.2 |
| 5,259,068 | A * | 11/1993 | Carroll | A41D 1/205 2/104 |
| 5,479,662 | A * | 1/1996 | Runco | A41D 1/215 2/104 |
| 5,544,364 | A * | 8/1996 | Weber | A41D 1/215 2/104 |
| 5,652,958 | A * | 8/1997 | Farrell-Mestas | A41D 1/215 2/48 |
| 6,216,274 | B1 * | 4/2001 | Harris | A41D 1/215 2/104 |
| 6,327,712 | B1 * | 12/2001 | Armstrong | A41D 1/215 2/104 |
| 8,151,372 | B2 * | 4/2012 | Densmore | A41D 1/215 2/104 |
| 9,003,565 | B1 * | 4/2015 | Leach | A41D 1/205 2/104 |

(Continued)

*Primary Examiner* — Sally Haden
*Assistant Examiner* — Jillian K Pierorazio
(74) *Attorney, Agent, or Firm* — Tracy Jong Law Firm; Tracy P. Jong; Cheng Ning Jong

(57) ABSTRACT

A nursing cover for a user, the nursing cover including a closed loop band having a front portion and a top opening through which the user is allowed to penetrate and a plurality of flexible boning supports disposed on the front portion. The plurality of flexible boning supports provides structural integrity while the user nurses an infant underneath the front portion to prevent the nursing cover from interfering with the infant being nursed by the user, to allow better circulation of airflow for the infant underneath the nursing cover and to provide a better line of sight for the nursing mother to view her infant underneath the nursing cover.

8 Claims, 17 Drawing Sheets

(56) References Cited

U.S. PATENT DOCUMENTS

| | | | | |
|---|---|---|---|---|
| 2008/0034463 | A1* | 2/2008 | Ekelund | A41D 1/215 2/104 |
| 2008/0301847 | A1* | 4/2008 | Holland | A41D 1/215 2/52 |
| 2008/0201817 | A1* | 8/2008 | Ostrander | A41D 1/215 2/52 |
| 2011/0296581 | A1* | 8/2011 | Armstrong | A41D 1/215 2/104 |
| 2012/0131723 | A1* | 5/2012 | Greenwood | A41D 23/00 2/104 |
| 2012/0151657 | A1* | 6/2012 | Gibbons | A41D 1/215 2/104 |
| 2012/0210492 | A1* | 8/2012 | Bielobocky | A41D 23/00 2/207 |
| 2012/0240306 | A1* | 9/2012 | Garegnani | A41D 1/215 2/104 |
| 2012/0284893 | A1* | 11/2012 | Sohn | A41D 1/215 2/46 |
| 2013/0042381 | A1* | 2/2013 | Yonover | A41D 15/00 2/74 |
| 2013/0152271 | A1* | 6/2013 | Clark | A41D 1/21 2/104 |
| 2013/0326795 | A1* | 12/2013 | Ortiz | A41D 15/00 2/243.1 |
| 2014/0007315 | A1* | 1/2014 | Toro-Gerstein | A41D 1/215 2/104 |
| 2015/0096102 | A1* | 4/2015 | Dick | A42B 1/008 2/171.3 |
| 2015/0366280 | A1* | 12/2015 | Fay | A41D 27/205 2/311 |
| 2018/0007980 | A1* | 1/2018 | Butler | A41D 31/00 |

* cited by examiner

FIG. 1
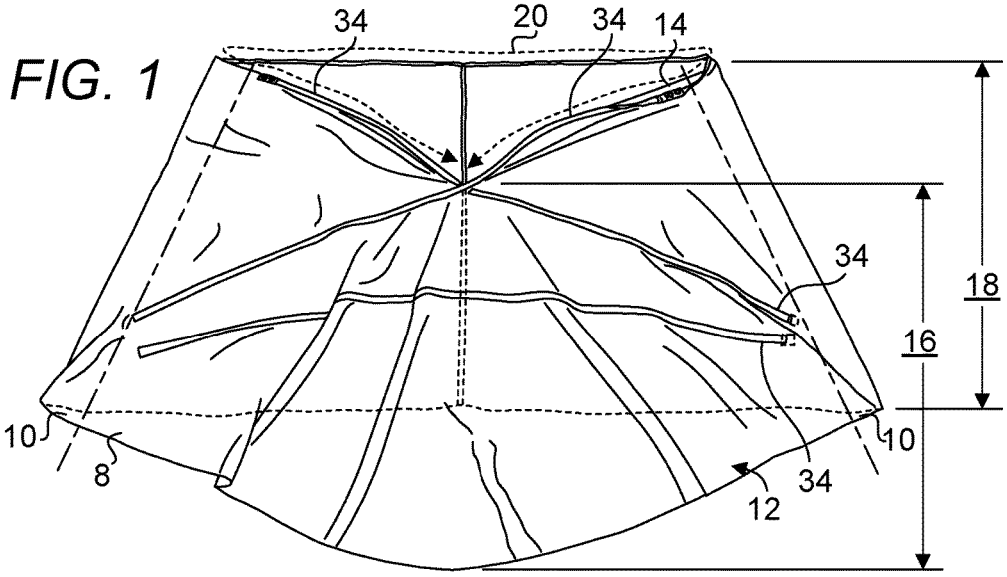
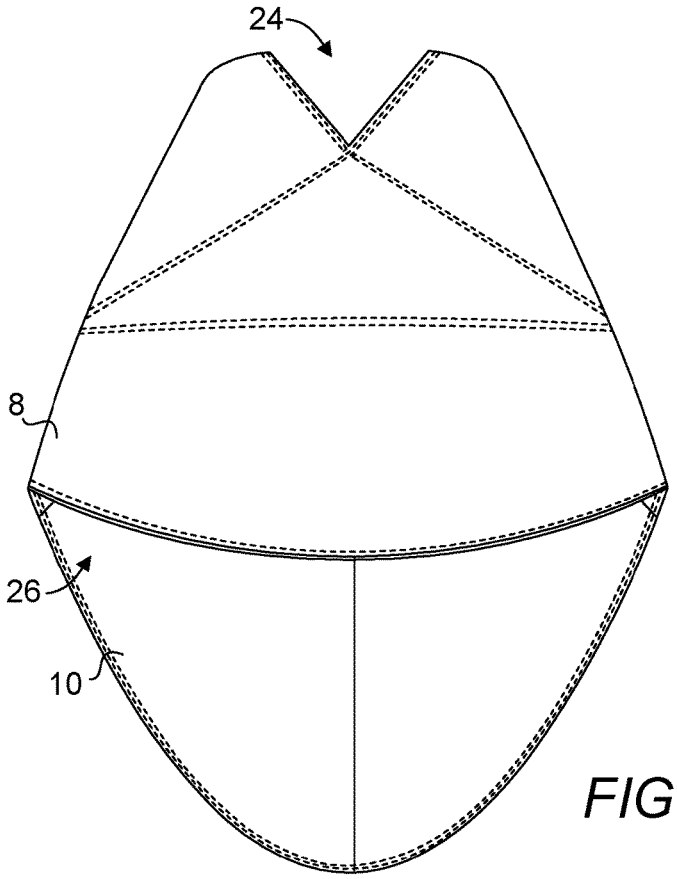
FIG. 2

NURSING COVER AND INFINITY SCARF

PRIORITY CLAIM AND RELATED APPLICATIONS

This non-provisional application claims the benefit of priority from application U.S. Ser. No. 62/266,542 filed on Dec. 11, 2015. Said application is incorporated by reference in its entirety.

BACKGROUND OF THE INVENTION

1. Field of the Invention

The present invention is directed to a nursing cover, and more particularly, a nursing cover and infinity scarf.

2. Background Art

Privacy and discretion is always important when women choose to breast feed their infants, particularly in public. Many times, women simply fold-up or put away their nursing cover after utilizing it to breast feed their infant. It would be useful to have a nursing cover that could easily be converted into a useful piece of women's clothing both for convenience, practicality and cost savings on woman's clothing. While having privacy is important to nursing women, it is also imperative that their infants are comfortable while nursing, e.g., without inadvertent coverings that are not only suffocating, but also obscuring lines of sight between the women and the nursing infants.

U.S. Pat. No. 9,003,565 to Jamie Leach (hereinafter Leach) discloses a fashion neck scarf comprising a hidden compartment that holds a nursing panel. The scarf may be an endless ring, or so-called "infinity" scarf, or a long rectangle. The nursing panel is sized to cover the front of the person and at least the infant's head and shoulders while the infant is nursing. A proximal edge of the panel is fixed to the scarf inside the compartment, and the nursing panel is alternately positionable between a stowed positioned in which the panel is compacted inside the compartment and a deployed position in which the panel is unfurled. This scarf may be arranged in several different fashionable configurations when the nursing panel is not in use. When nursing the infant, the scarf can be arranged in different ways to maximize the user's comfort and to secure the panel in position and prevent it from being displaced inadvertently. Leach discloses a neck scarf which lacks a support for maintaining its nursing panel in an erected position. Leach's nursing panel may only be used to cover a nursing infant partially and cannot be secured.

There exists a need for a nursing cover which is readily available to a nursing woman and a nursing cover which is capable of providing privacy to the nursing woman while maintaining a "micro" environment which is comfortable for both the nursing woman and her infant.

SUMMARY OF THE INVENTION

Disclosed herein is a nursing cover for a user, the nursing cover including a closed loop band having a front portion and a top opening through which the user is allowed to penetrate and a plurality of flexible boning supports disposed on the front portion. The plurality of flexible boning supports provides structural integrity while the user nurses an infant underneath the front portion to prevent the nursing cover from interfering with the infant being nursed by the user, to allow better circulation of airflow for the infant underneath the nursing cover and to provide a better line of sight for the nursing mother to view her infant underneath the nursing cover.

The flexible elongated boning supports are each disposed within one of a plurality of elongated channels disposed on the front portion. In one configuration, the front portion is worn covering a user's entire torso. In another configuration, the front portion is worn covering a user's left shoulder and tucked underneath a user's right armpit. In yet another configuration, the front portion is worn covering a user's right shoulder and tucked underneath a user's left armpit. In yet other configurations, the front portion is draped over a user's elbow, looped around a user's arm or resting on the user's shoulders. The flexible elongated boning supports are preferably removed when the nursing cover is transformed into an infinity scarf although they may be left inserted in the elongated channels if the user does not intend to deal with the effort and time in switching between the present invention used as an infinity scarf and a nursing cover.

While not in use as a nursing cover, the infinity scarf is configured to be single-looped or double-looped for convenience and portable storage. The front portion is made of cotton, jersey-knit fabric, woven fabric, muslin or a colored material that is non-see-through or see-through material. Each flexible elongated boning support includes a rounded tip to facilitate insertion and removal of the flexible elongated boning support from an elongated channel. In one embodiment, a flexible elongated boning support is constructed from a plastic material. In another embodiment, a flexible elongated boning support is constructed from a metallic material capped with anti-snagging ends.

It is an object of the present invention to provide a nursing cover that is readily available when it is required.

It is an object of the present invention to provide a nursing cover which can be used for other purposes such that its use and therefore, its availability, is increased.

It is an object of the present invention to provide a nursing cover and infinity scarf that is structurally supported by a plurality of flexible boning supports that provide added structural integrity and shape.

It is an object of the present invention to provide a nursing cover that provides flexible elongated boning supports.

It is an object of the present invention to provide a nursing cover and infinity scarf that may be single-looped or double-looped while being utilized as an infinity scarf.

It is an object of the present invention to provide a nursing cover and infinity scarf that may be single-looped or double-looped and tie into a FIG. 8 bow before gathering the loops together to form a reduced-sized infinity scarf.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 1 illustrates a front view of a nursing cover and infinity scarf with flexible boning supports removed.

FIG. 2 illustrates a front view of a nursing cover and infinity scarf with flexible boning supports incorporated therein.

FIG. 4 illustrates one embodiment of a template from which a nursing cover and infinity scarf is constructed from.

PARTS LIST

2—user
4—infant
6—nursing cover and infinity scarf
8—front portion of nursing cover and infinity scarf
10—rear portion of nursing cover and infinity scarf
12—exterior surface of front portion of nursing cover and infinity scarf
14—interior surface of front portion of nursing cover and infinity scarf
16—width of front portion of nursing cover and infinity scarf
18—width of rear portion of nursing cover and infinity scarf
20—top periphery of nursing cover and infinity scarf
22—elongated flexible boning supports
24—top opening
26—bottom opening
28—securing means, e.g., complementary snap fasteners, complementary hook
and loop pieces, complementary magnetic materials
30—seams
32—seams
34—channels
36—top opening cut angle
38—rounded tip
40—angle between criss-crossed channels

Particular Advantages of the Invention

Traditional nursing covers are well-known to those schooled in the art and they have the same general shape capable of being draped over the torso of a nursing mother to cover an infant being breastfed by the nursing mother. The nursing cover and infinity scarf includes a plurality of flexible boning supports that provide added structural integrity and shape while a user nurses an infant underneath the front portion to prevent the nursing cover from interfering with the infant being nursed by the nursing mother, to allow better circulation of airflow for the infant underneath the nursing cover and infinity scarf and to provide a better line of sight for the nursing mother to view her infant underneath the nursing cover and infinity scarf. The flexible elongated boning supports are each disposed within one of a plurality of elongated channels disposed on the front portion. In one embodiment, the flexible elongated boning supports each have a plastic rounded tip to facilitate inserting and removing the flexible elongated boning supports from the elongated channels. The front portion is worn covering a user's entire torso, covering a user's left shoulder and tucked underneath a user's right armpit, covering a user's right shoulder and tucked underneath a user's left armpit, draped over a user's elbow, looped around a user's arm or resting on the user's shoulders.

DETAILED DESCRIPTION OF A PREFERRED EMBODIMENT

The term "about" is used herein to mean about, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 3:
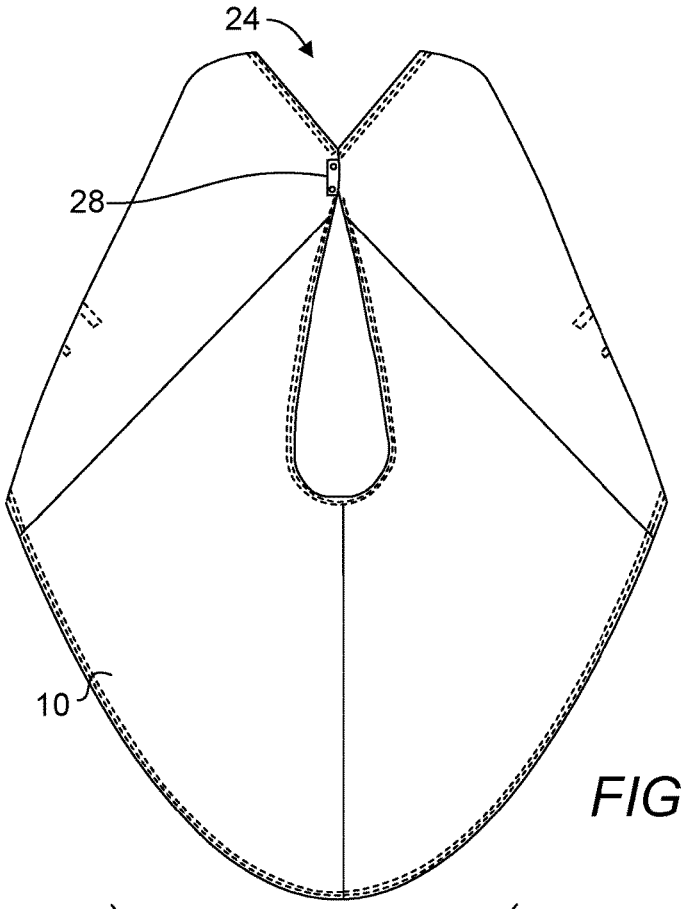
FIG. 3 illustrates a rear view of a nursing cover and infinity scarf with flexible boning supports incorporated therein.

FIG. 1 illustrates a front view of a nursing cover and infinity scarf 6. FIG. 2 illustrates a front view of a nursing cover and infinity scarf with flexible boning supports incorporated therein. FIG. 3 illustrates a rear view of a nursing cover and infinity scarf with flexible boning supports incorporated therein. For simplicity, the nursing cover and infinity scarf 6 may be referred to simply as nursing cover. The nursing cover is essentially a closed loop band having a front portion 8, a rear portion 10, a top opening 24 and a bottom opening 26. In use, a user dons the nursing cover by putting it over and around the user such that the user's head penetrates the lower and upper openings. A plurality of flexible boning supports are disposed on the front portion where they provide structural integrity to the front portion while the user nurses an infant underneath the front portion and prevent the nursing cover from interfering with the infant being nursed by the user, to allow better circulation of airflow for the infant underneath the nursing cover and to provide a better line of sight for the nursing mother to view her infant underneath the nursing cover. The front portion 8 includes an exterior surface 12 and an interior surface 14. The elongated flexible boning supports may be disposed on the exterior surface 12 or the interior surface 14 of the nursing cover although for aesthetics, the supports are preferably disposed on the interior surface 14. The front portion 8 may be made of cotton, jersey-knit fabric, woven fabric, muslin or a colored material that is non-see-through or see-through material or the like. For ease of construction, the front and rear portions may be made of the same material. The use of woven fabric for the nursing cover enhances its structural strength especially around the neck area which causes the material in the same area to "stand up," further enhancing the curved dome-shaped front portion. The width 16 of the front portion 8 is preferably in the range of from about 20 to about 25 inches and the width 18 of the rear portion 10 is preferably in the range of from about 24 to about 28 inches. The circumference of the top periphery 20 of the nursing cover and infinity scarf 6 preferably ranges from about 79 to about 83 inches. Referring to FIG. 3, it shall be noted that the top opening 24 of the nursing cover may be restricted by engaging the complementary securing means 28, e.g., complementary snap fasteners, complementary hook and loop pieces and complementary magnetic materials. As shall be appreciated from the ensuing FIGS. 5 and 10, coupling of the securing means 28 causes the nursing cover to be secured around a user's neck.

Figure 4:
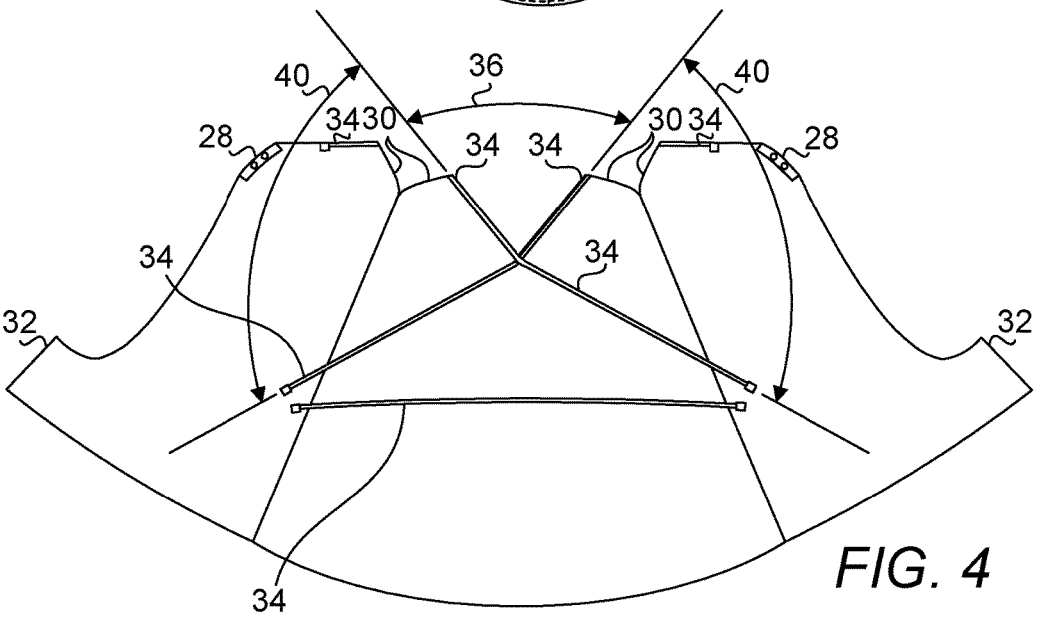

FIG. 4 illustrates one embodiment of a template from which a nursing cover and infinity scarf is constructed from. The template is formed in such a manner that when neighboring top seams 30 are joined together, a curved dome-shaped cover can be formed. When the bottom seams 32 are joined together, a closed loop band is formed. In one embodiment, the channels 34 are configured to be criss-crossed at the top of the front portion 8 and laid across spanning the length of the front portion 8. With the template laid flat, the top opening is outlined by a V-shaped cut having an angle 36 of from about 45 degrees to about 90 degrees. In the embodiment shown, a channel 34 is configured to outline each edge of the V-shaped cut and continues to deviate slightly from each edge of the V-shaped cut. In one embodiment, angle 40 ranges from about 45 to about 90 degrees. In one embodiment, a channel is an elongated tube constructed, e.g., from a material that is similar or identical to the material used for fabricating the front and/or rear portion of the closed loop band such that it blends in well with the front portion material. Each channel 34 is preferably attached, e.g., via, stitching, along its entire length to the front portion such that the lifting force afforded by the boning support inserted therein, can be applied to the area along the entire length of the channel.

Figure 5:
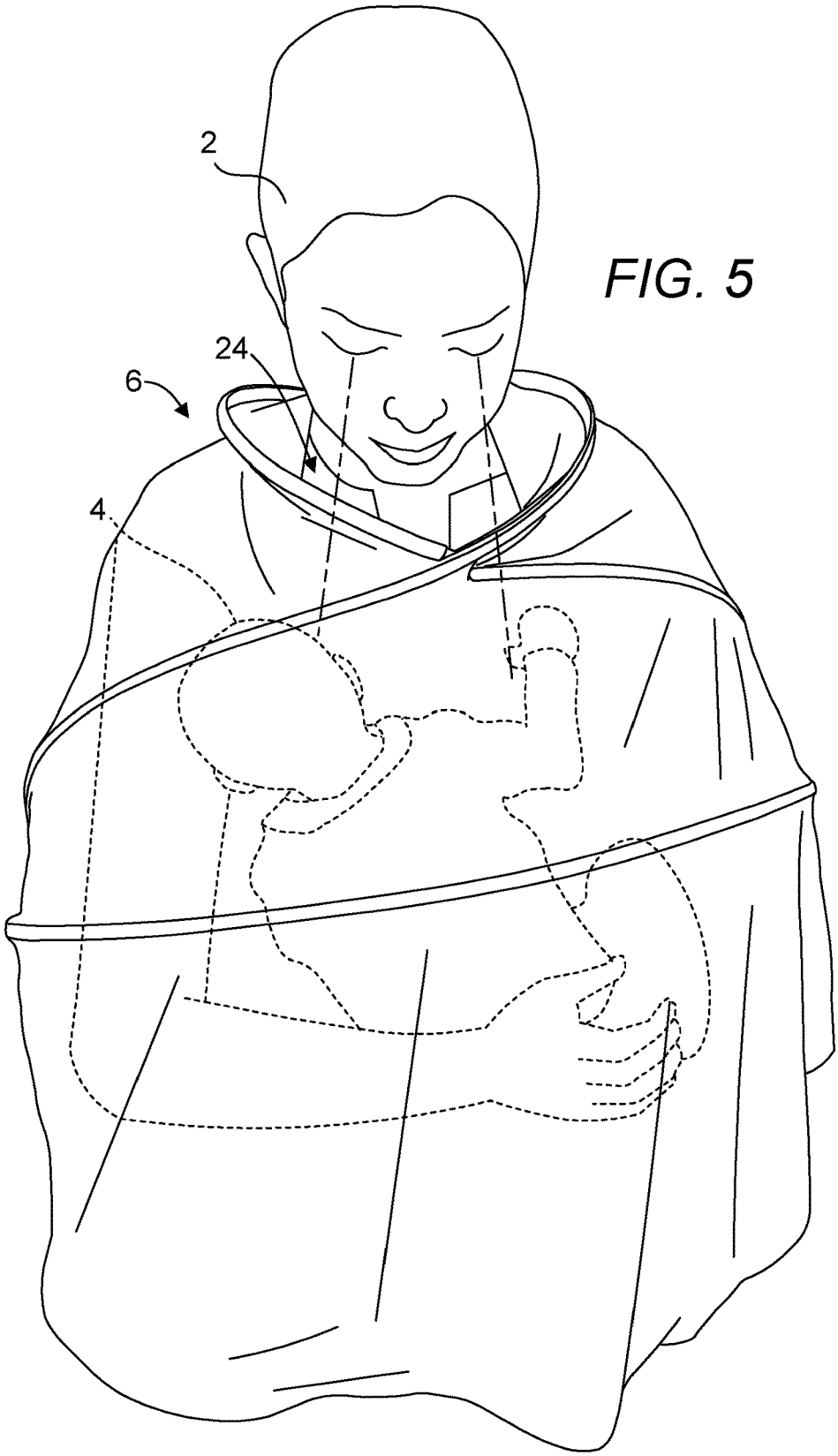
FIG. 5 illustrates a front environmental perspective view of a nursing cover and infinity scarf with both user shoulders covered.
Figure 6:
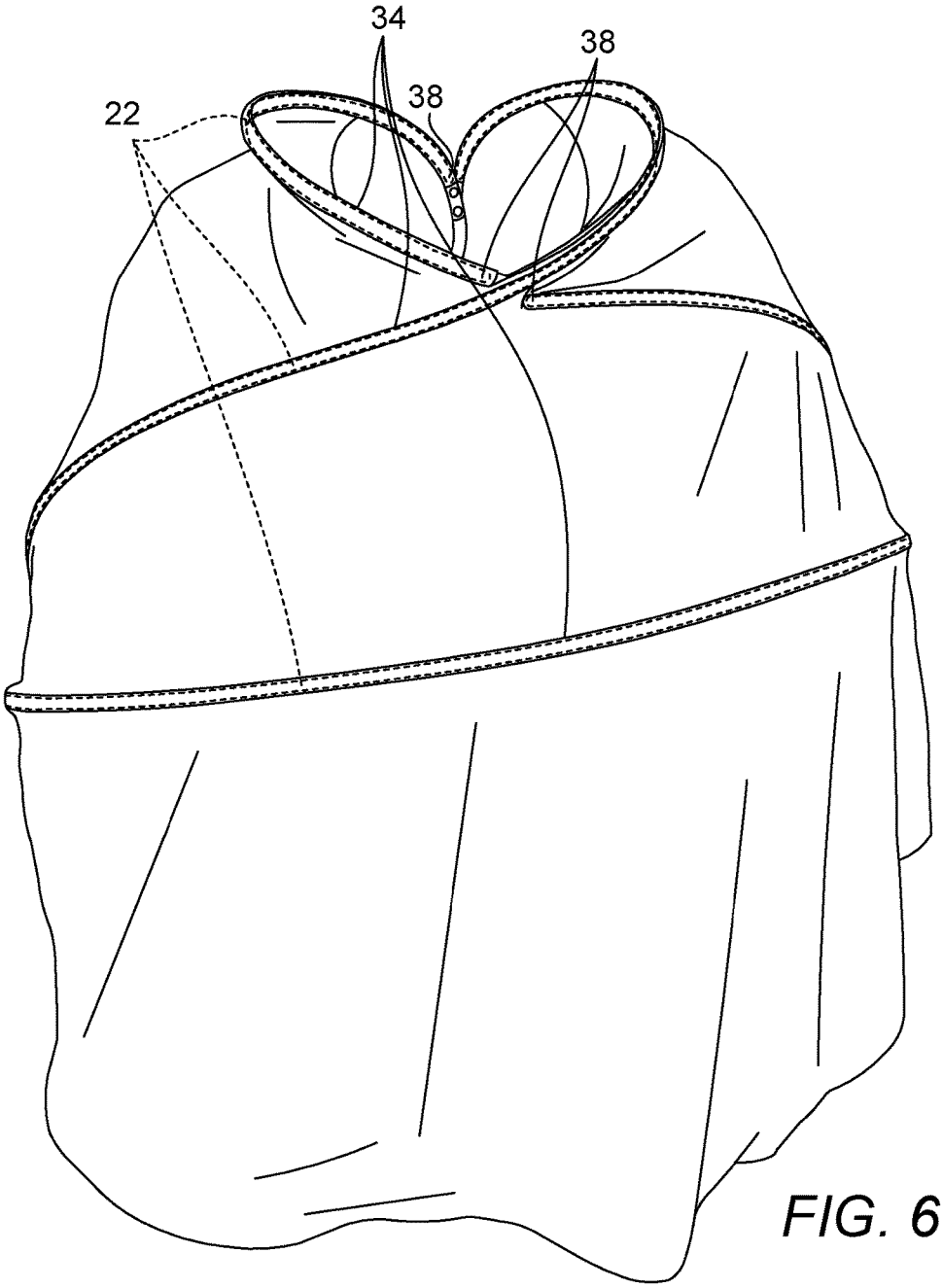
FIG. 6 illustrates a front environmental perspective view of a nursing cover and infinity scarf with a plurality of flexible boning supports and a plurality of elongated channels.

FIG. 5 illustrates a front environmental perspective view of a nursing cover and infinity scarf 6 with both user shoulders covered. The nursing cover and infinity scarf 6 illustrated in FIG. 5 is worn covering a user 2, an infant 4 and the user's torso. It shall be noted that opening 24 and the elongated flexible boning supports together allow the user 2 to have a better line of sight for the nursing mother to view her infant 4 underneath the nursing cover 6. The boning supports prevent the nursing cover from interfering with the infant 4 being nursed by the user 2 and allow better airflow and circulation for the infant 4 underneath the nursing cover 6. FIG. 6 illustrates a front environmental perspective view of a nursing cover and infinity scarf 6 with a plurality of elongated flexible boning supports 22 and a plurality of elongated channels 34. The elongated flexible boning supports 22 and the elongated channels 34 may overlap each other while disposed on the interior surface 14 of the front portion 8. Referring to FIG. 6, for the channels 34 shown in the criss-crossed pattern, one of the channels may be one long continuous path for receiving for receiving a support. Supports arranged around this long continuous path may be received in two separate channels. Such a configuration, coupled with the channel arranged across the length of the first portion, allow the nursing cover to be collapsed and gathered to form an infinity scarf even with the supports remain inserted in the channels. With or without the boning supports, the nursing cover 6 may also be used as a poncho.

Figure 7:
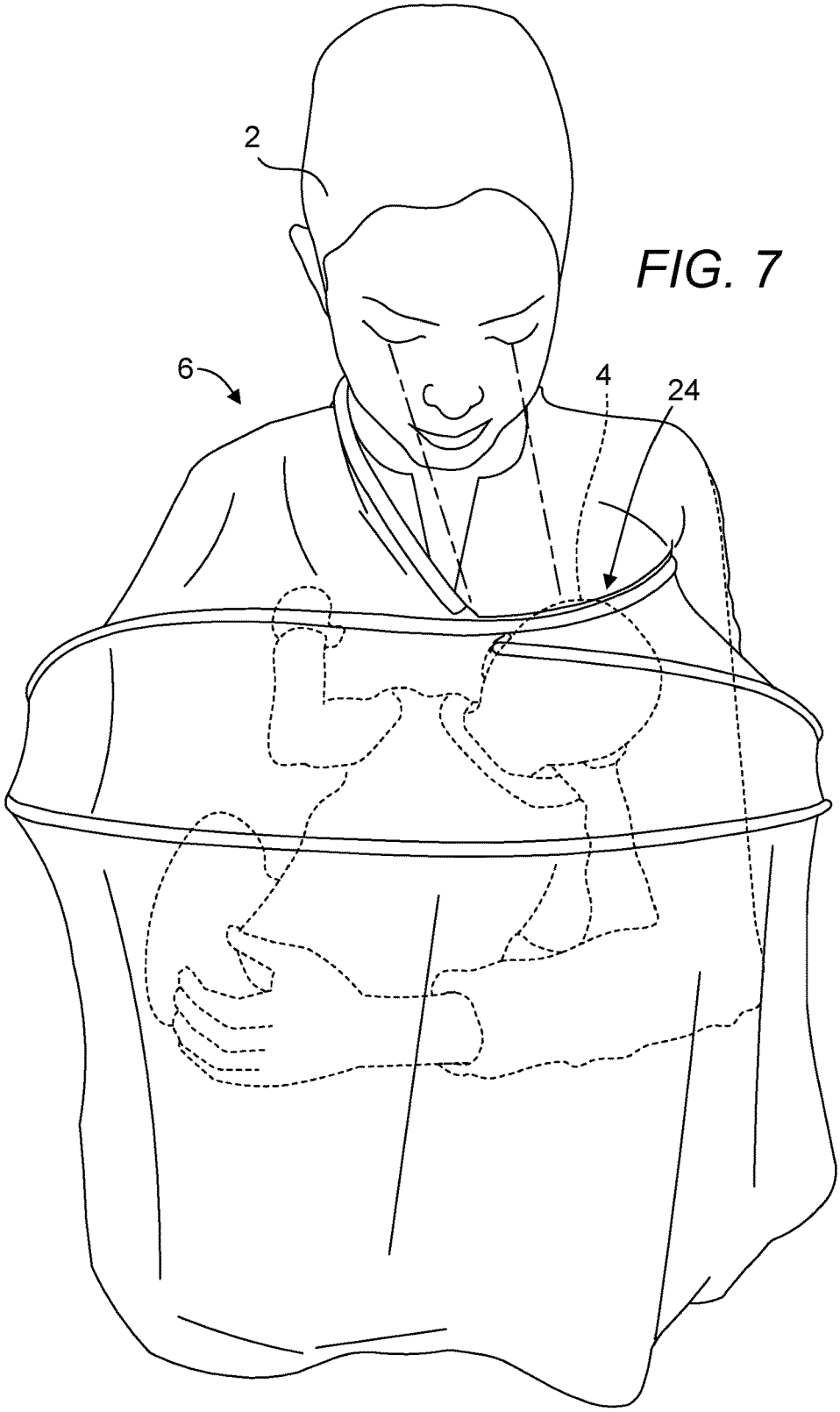
FIG. 7 illustrates a front environmental perspective view of a nursing cover and infinity scarf with one user shoulder covered.

FIG. 7 illustrates a front environmental perspective view of a nursing cover 6 with one user shoulder covered. The nursing cover 6 illustrated in FIG. 7 is worn covering the user 2, an infant 4 and the user's left shoulder and tucked underneath the user's right armpit. Again, the user 2 can maintain a better line of sight with her infant 4 and enjoy all of the benefits disclosed elsewhere herein.

Figure 8:
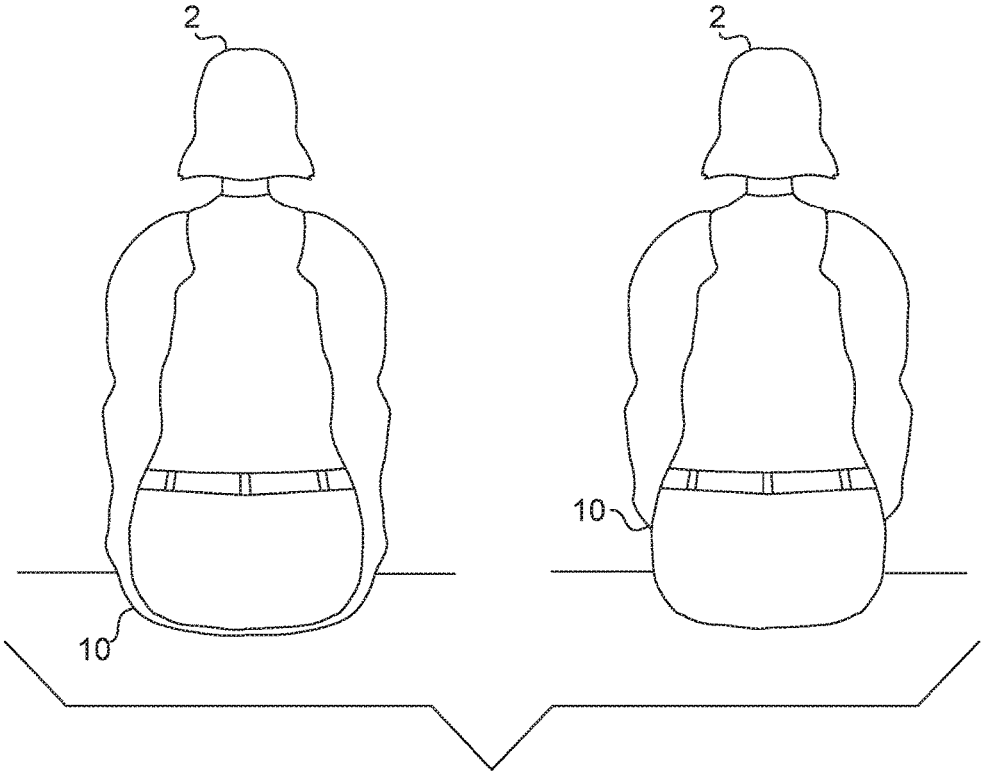
FIG. 8 illustrates a rear environmental perspective view of a nursing cover and infinity scarf on the left and a nursing cover and infinity scarf on the right.

FIG. 8 illustrates a rear environmental perspective view of a nursing cover and infinity scarf on the left and a nursing cover and infinity scarf on the right. The nursing cover on the left illustrates a rear portion 10 of the nursing cover positioned behind a user 2. The nursing cover on the right illustrates a rear portion 10 of the nursing cover draped on the user's lap. The rear portion 10 may be sat-on by the user 2 to secure the nursing cover over the infant 4. The rear portion 10 may not be sat-on by the user 2 and may be utilized to cover an infant 4.

Figure 9:
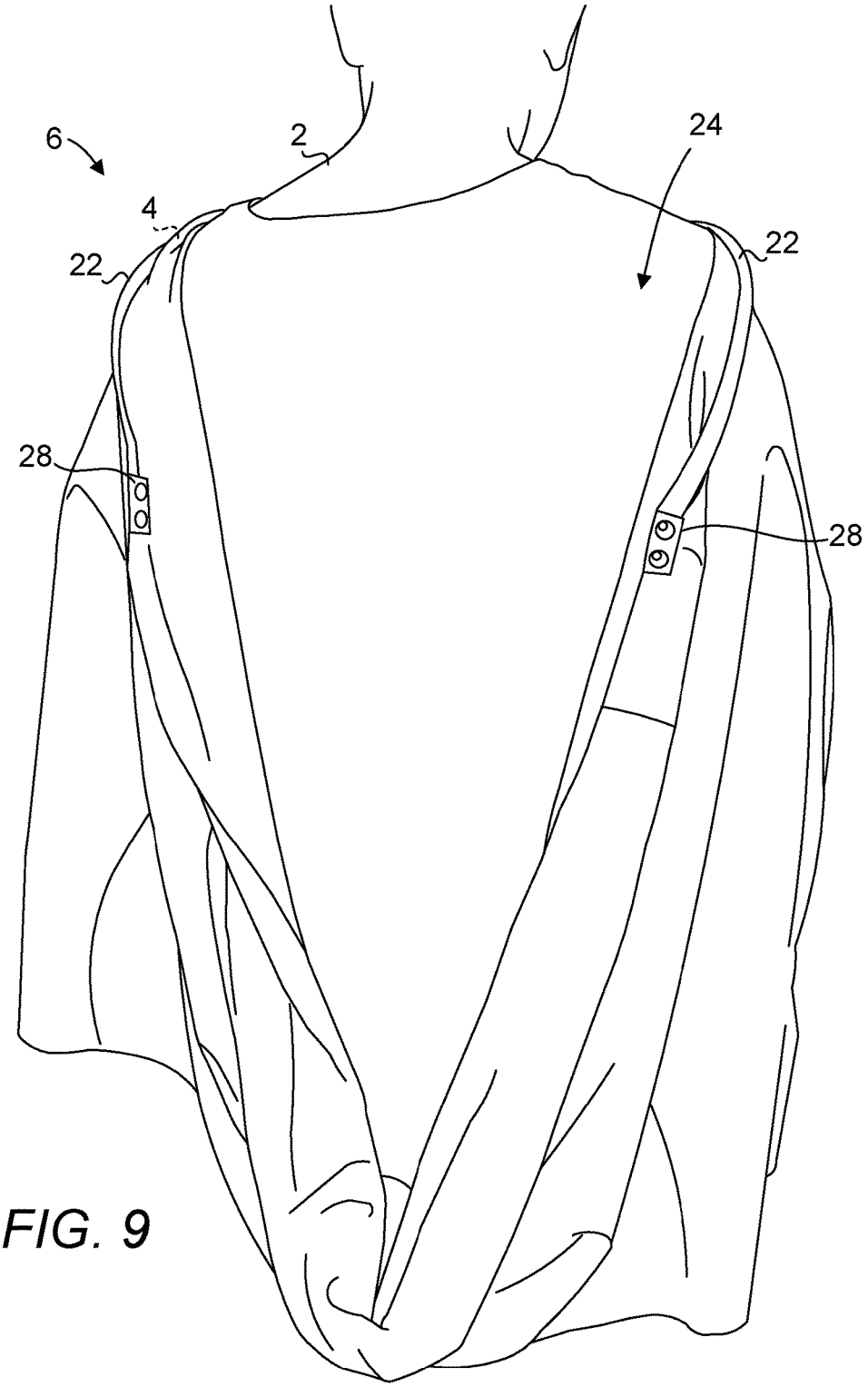
FIG. 9 illustrates a rear environmental perspective view of a nursing cover and infinity scarf.
Figure 10:
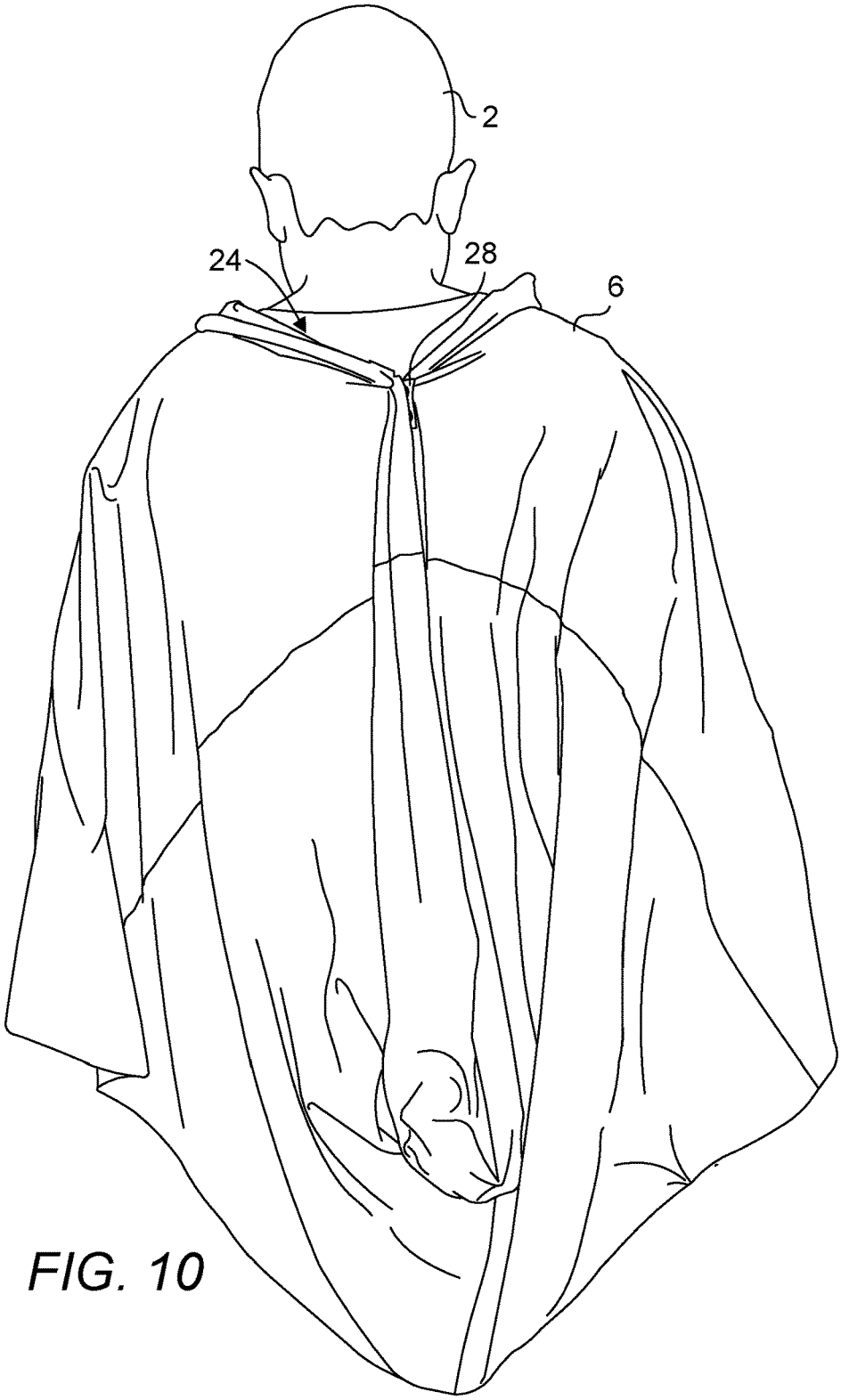
FIG. 10 illustrates a rear environmental perspective view of a nursing cover and infinity scarf where the top opening is restricted.

FIG. 9 illustrates a rear environmental perspective view of a nursing cover and infinity scarf 6. It shall be noted that the complementary securing means 28 are not engaged, leaving a large opening 24. FIG. 10 illustrates a rear environmental perspective view of a nursing cover and infinity scarf where the top opening is restricted. It shall be noted that the complementary securing means 28 are now engaged, leaving a smaller opening 24 around the user's neck.

Figure 11:
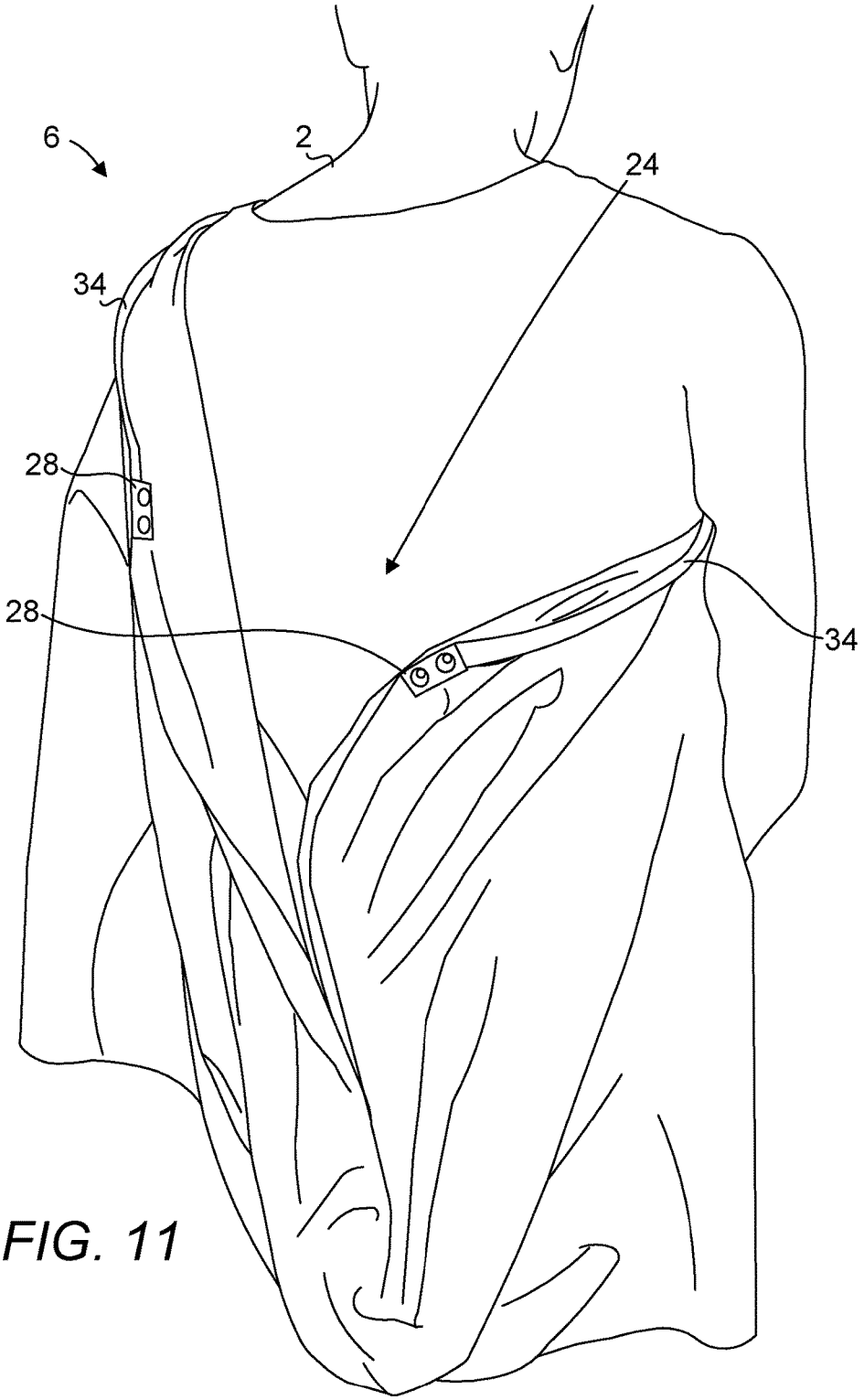
FIG. 11 illustrates a rear environmental perspective view of a nursing cover and infinity scarf.

FIG. 11 illustrates a rear environmental perspective view of a nursing cover and infinity scarf 6. The nursing cover 6 is worn covering the user 2 and the user's left shoulder and tucked underneath the user's right armpit. Again, it shall be noted that the complementary securing means 28 are not engaged leaving a large opening 24.

Figure 12:
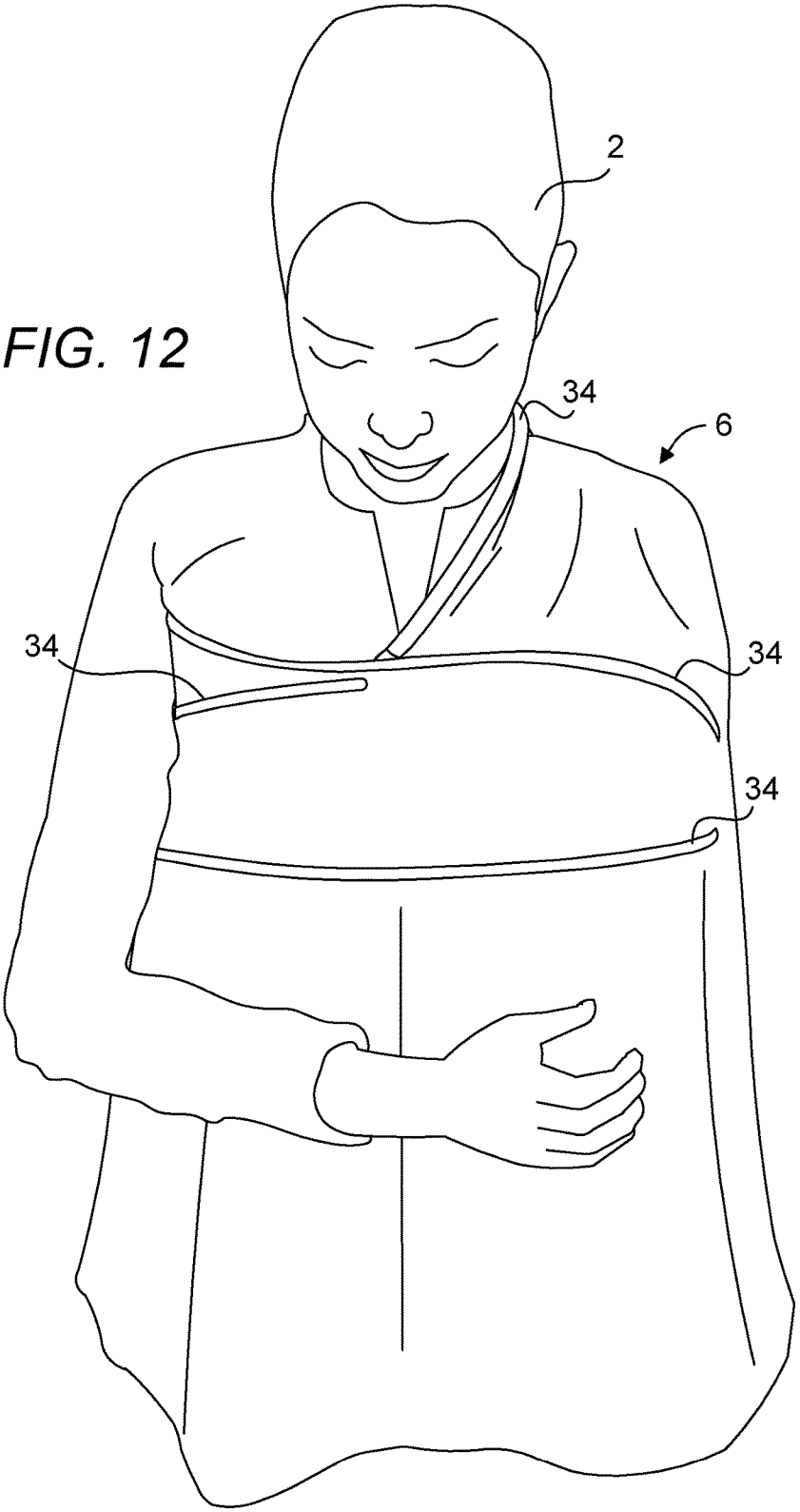
FIG. 12 illustrates a front environmental perspective view of a nursing cover and infinity scarf being worn by a user without a plurality of boning supports.

FIG. 12 illustrates a front environmental perspective view of a nursing cover and infinity scarf 6 being worn by a user 2 without a plurality of flexible boning supports. FIG. 12 illustrates the nursing cover 6 that covers a user's left shoulder and is tucked underneath a user's right armpit. Alternatively, flexible boning supports may be left inserted in the channels 34.

Figure 13:
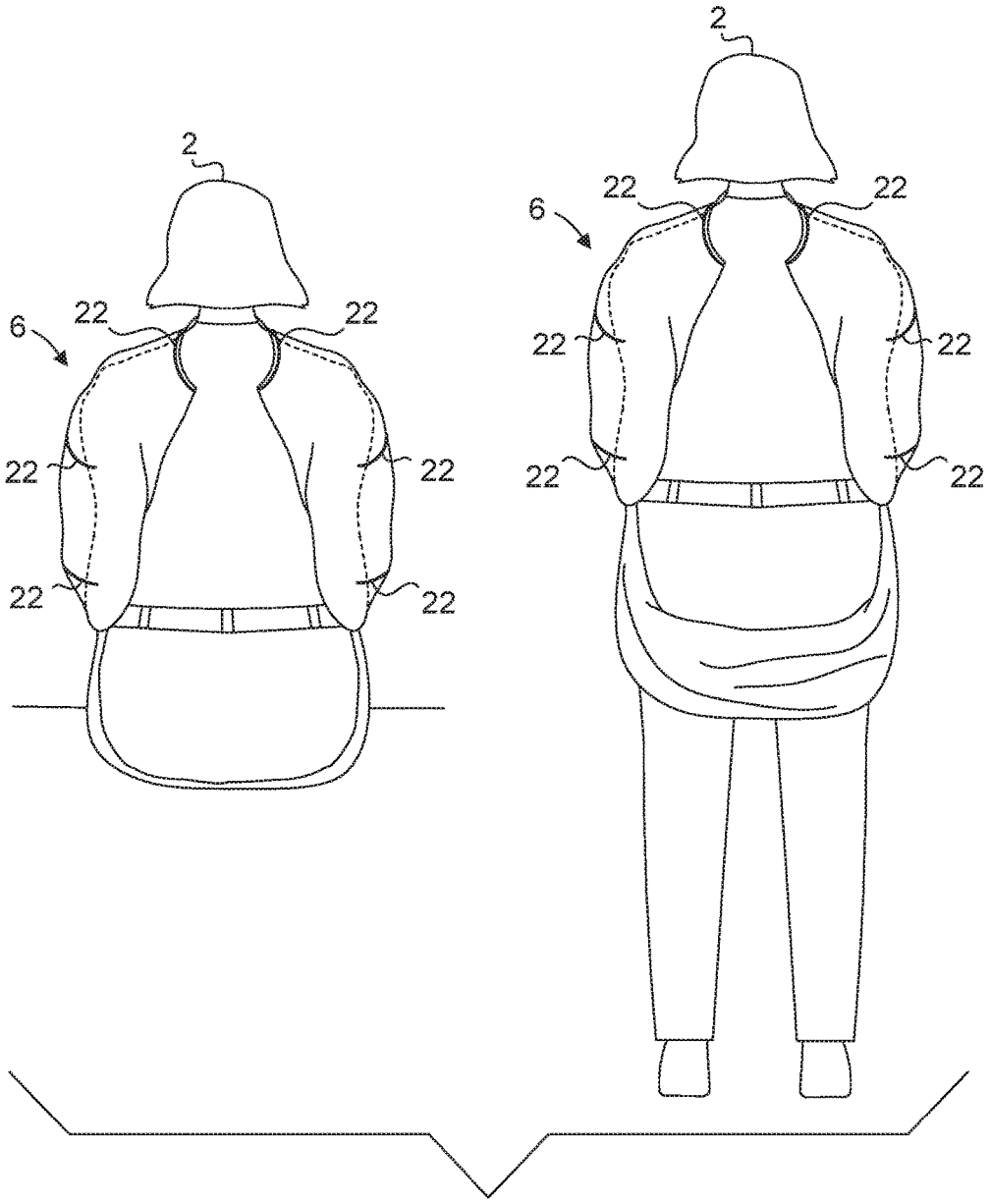
FIG. 13 illustrates a rear environmental perspective view of a nursing cover and infinity scarf in a sitting and a standing position of a user.

FIG. 13 illustrates a rear environmental perspective view of a nursing cover 6 in a sitting position and a standing position of a user. The flexible boning supports 22 are disposed along the user's arms, upper back and neck and provide structural integrity to the nursing cover and infinity scarf 6 worn on the user's arms, upper back and neck. The nursing cover 6 may be resting on the user's shoulders.

Figure 14:
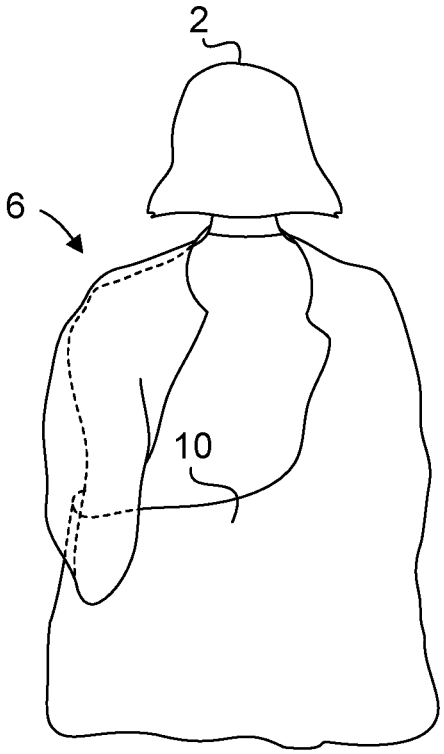
FIG. 14 illustrates a rear environmental perspective view of a nursing cover and infinity scarf.

FIG. 14 illustrates a rear environmental perspective view of a nursing cover 6. The rear portion 10 provides additional materials which may be draped over a user's elbow to provide additional warmth to the user.

Figure 15:
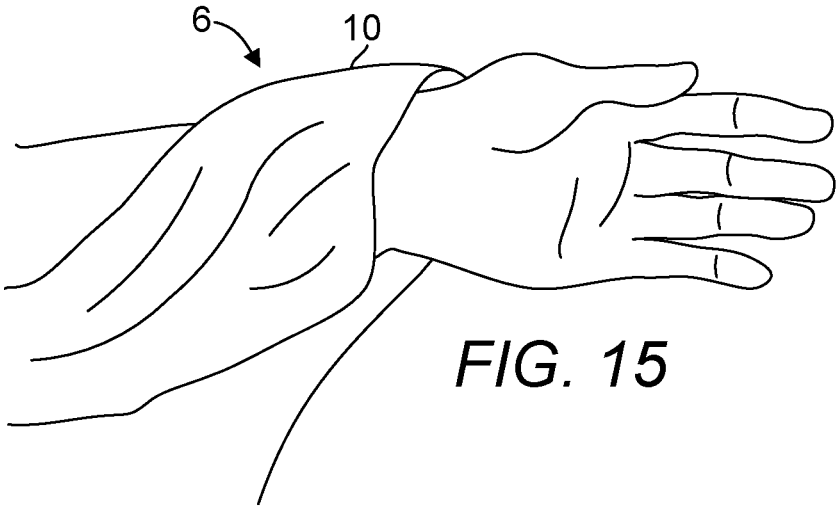
FIG. 15 illustrates a front environmental perspective view of a nursing cover and infinity scarf looped around a user's arm.

FIG. 15 illustrates a front environmental perspective view of a nursing cover 6 looped around a user's arm. The rear portion 10 provides additional materials which may be looped around the user's arm to provide additional warmth to the user.

Figure 16:
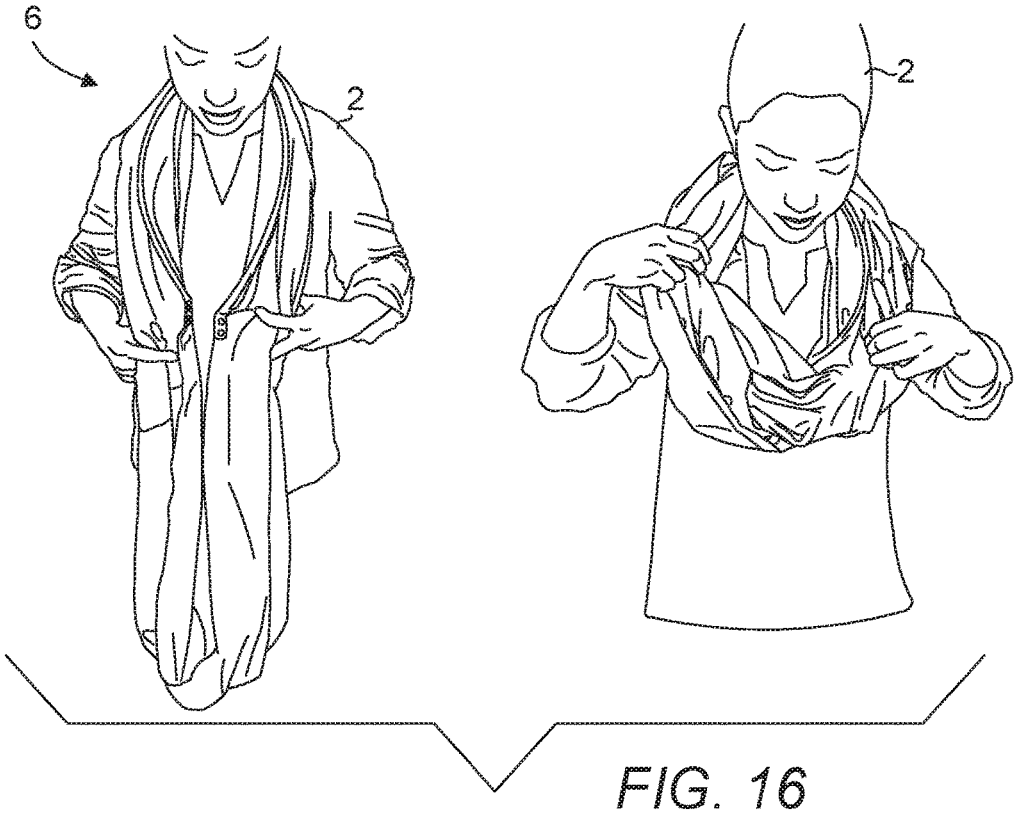
FIG. 16 illustrates a front environmental perspective view of a nursing cover and infinity scarf and a reduced-size infinity scarf.

FIG. 16 illustrates a front environmental perspective view of a single-looped nursing cover 6 used as an infinity scarf by a user 2 on the left and a reduced-size or double-looped infinity scarf on the right. The nursing cover 6 may be converted into and used as an infinity scarf by removing the flexible boning supports 22 or leaving the flexible boning supports 22 in when the infinity scarf is worn. Therefore, the infinity scarf may be single-looped or double-looped for convenience and portable storage with or without the flexible boning supports 22.

Figure 17:
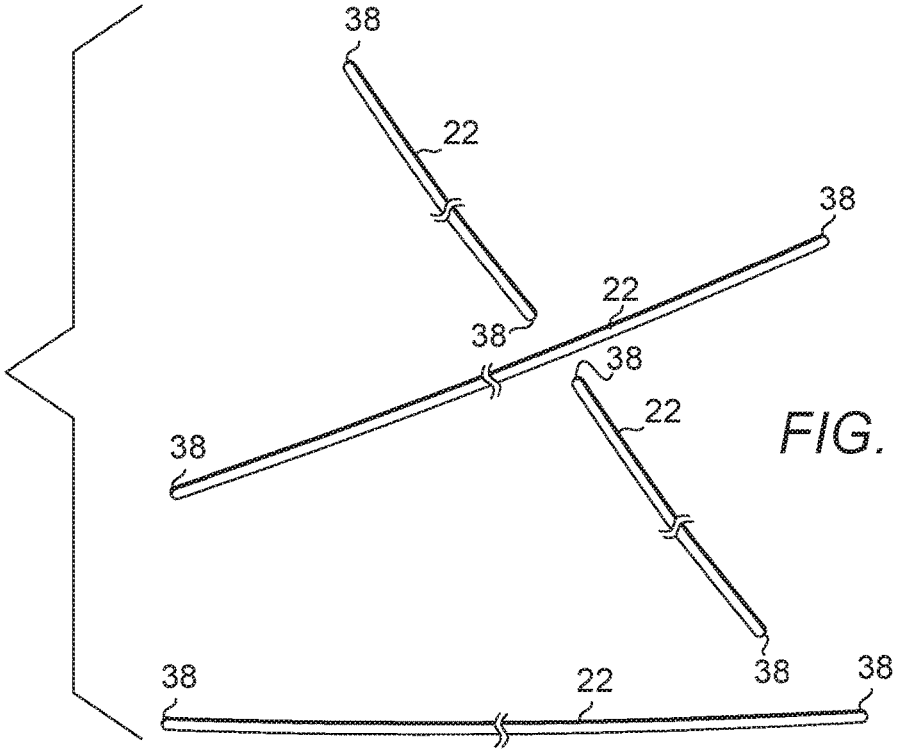
FIG. 17 illustrates a perspective view of a plurality of flexible boning supports.

FIG. 17 illustrates a perspective view of a plurality of flexible boning supports 22. A boning support may be constructed as flat elongated strips or cylindrical elongated rod with their longitudinal ends rounded to form rounded tips to prevent snagging while the support is being inserted into a channel. Each boning support may be constructed from, but not limited to, plastic, fiberglass and carbon fiber, in an extrusion or molding process. In another embodiment, each boning support may be constructed from a polymer-dipped or coated metal rods capped with round plastic tips to avoid snagging at their ends. Rounded tips 38 facilitate inserting and removing of the elongated flexible boning supports 22 from elongated channels 34. In a preferred embodiment, elongated channels 34 are disposed on the interior surface 14 of the front portion 8.

Figure 18:
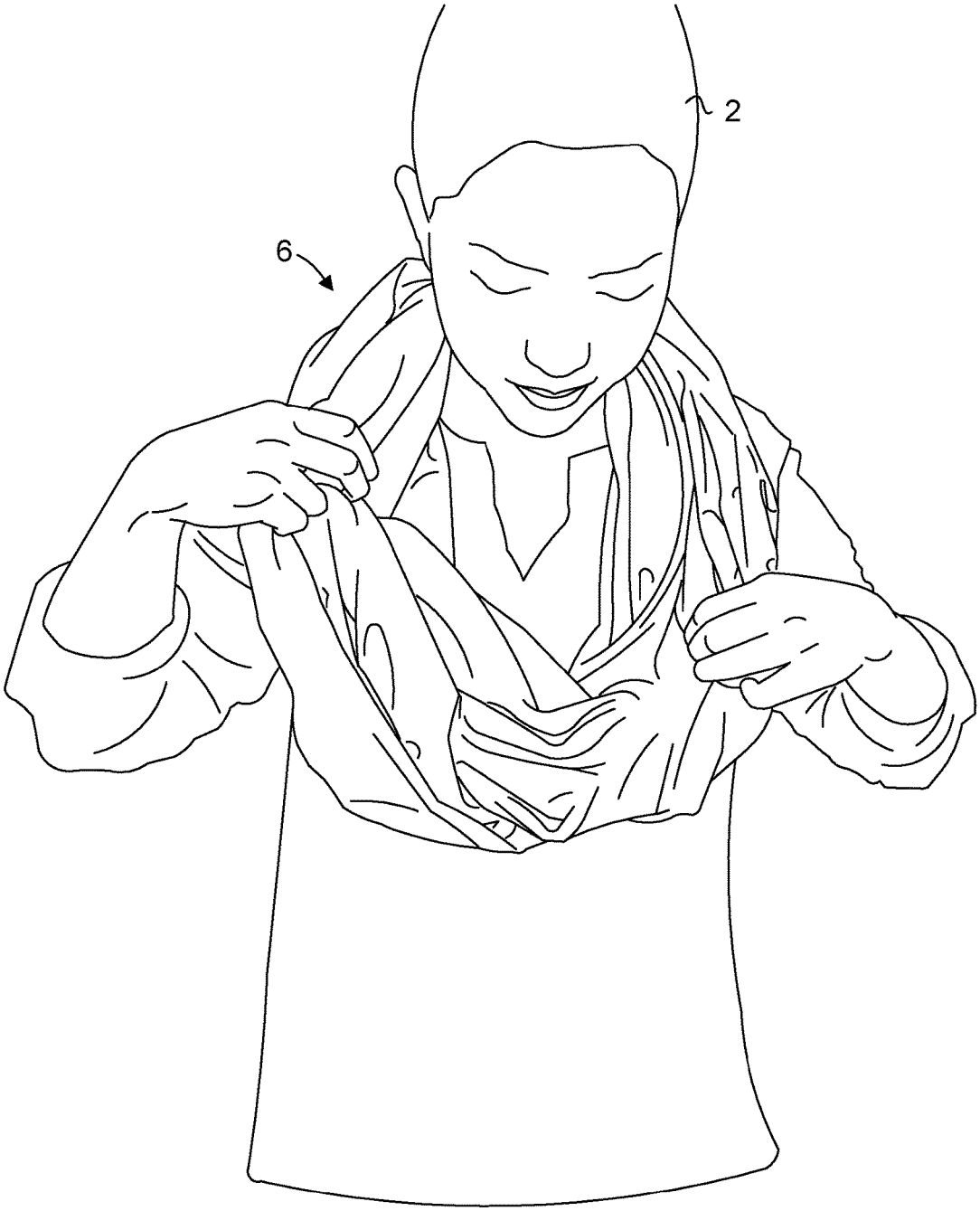
FIG. 18 illustrates a nursing cover being worn by a user where the nursing cover has been converted to an infinity scarf.
Figure 19:
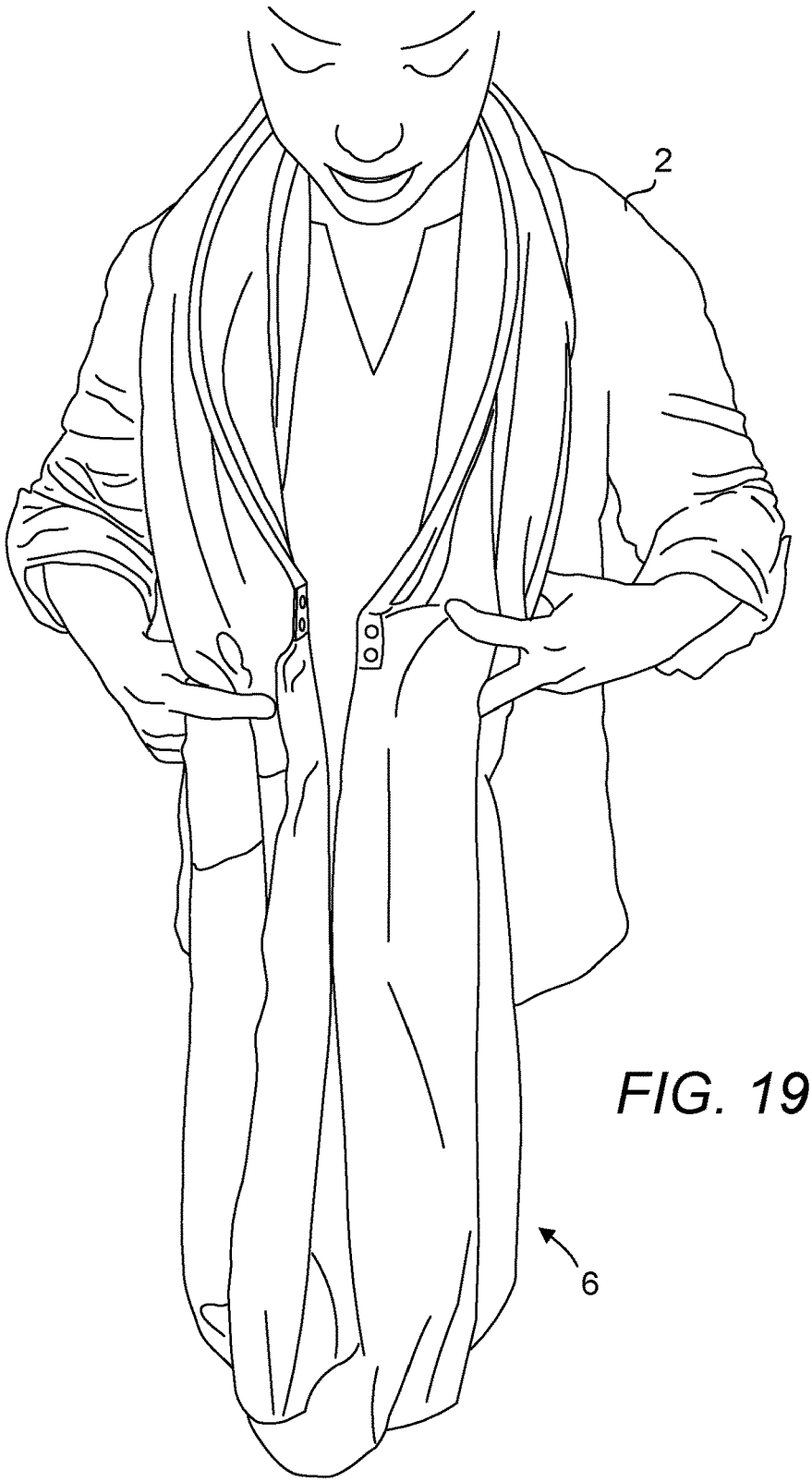
FIGS. 19-21 illustrate a series of steps taken to form a double loop.
Figure 20:
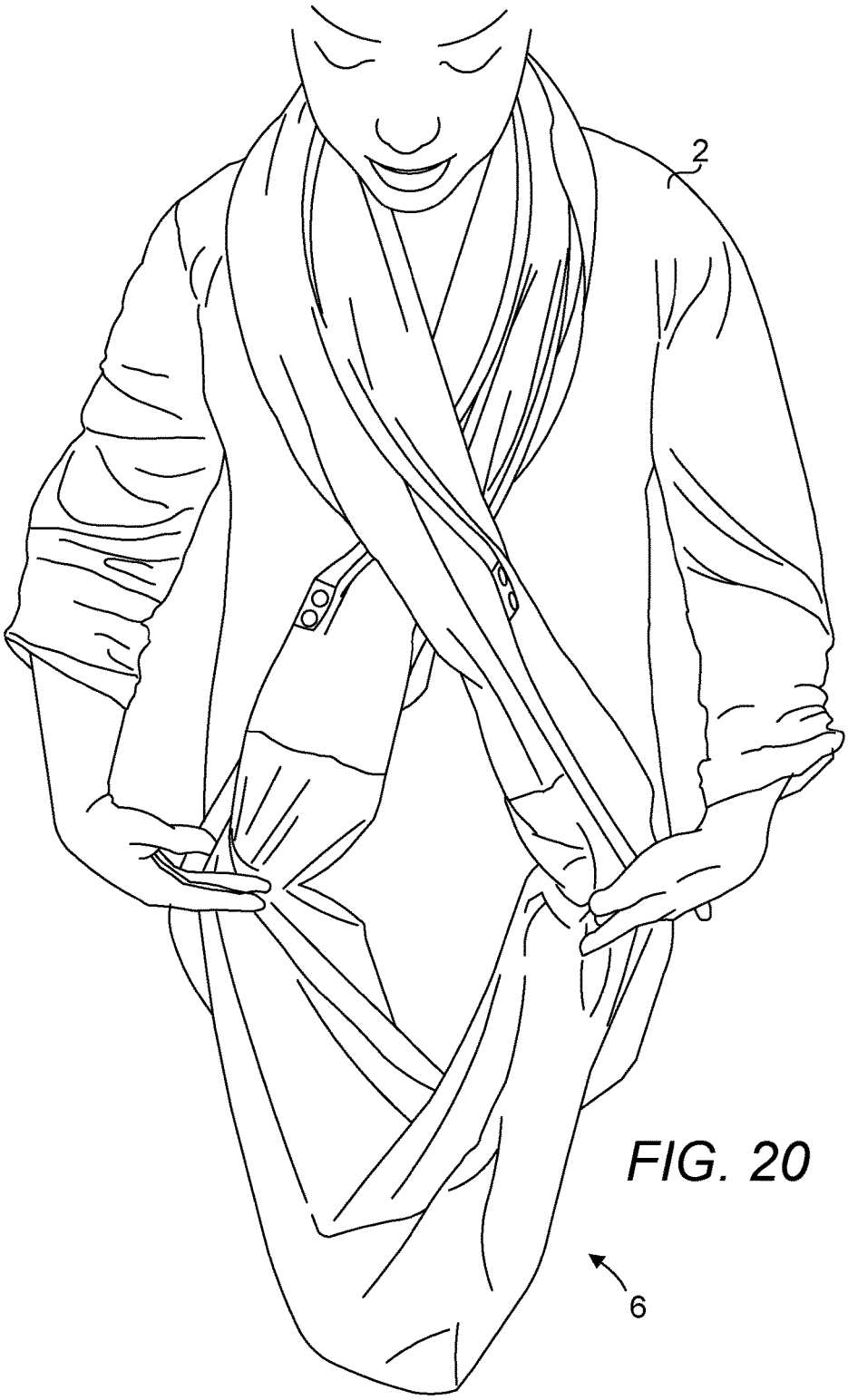
Figure 21:
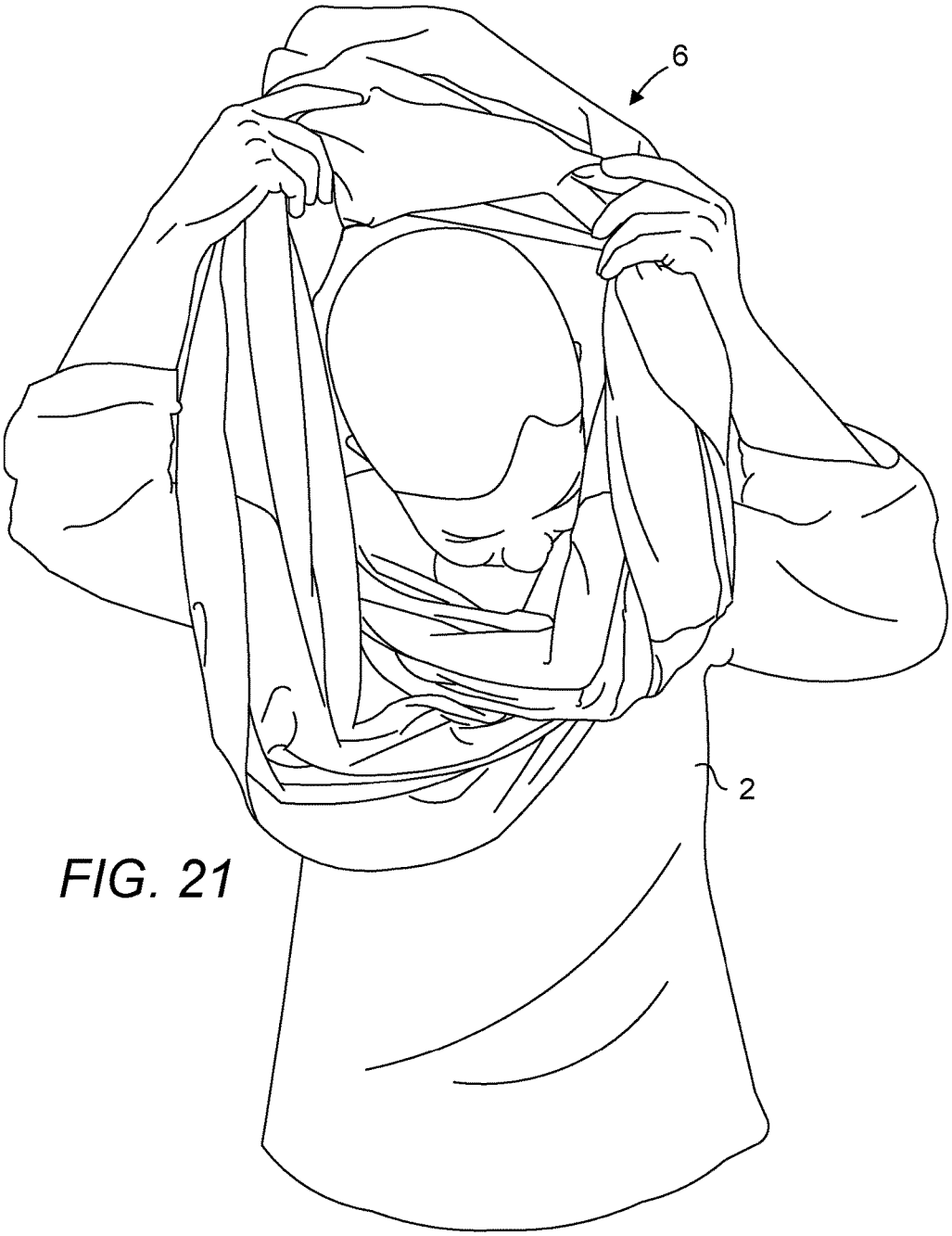

FIG. 18 illustrates a nursing cover being worn by a user 2 where the nursing cover 6 has been converted to an infinity scarf while the nursing cover 6 is not being used as a nursing cover. As the nursing cover can be transformed into a wearable infinity scarf, the user has access to a nursing cover at all times, removing the need to stow the nursing cover away when it is not needed. FIGS. 19-21 illustrate a series of steps taken to form a double-looped infinity scarf from the nursing cover 6. In FIG. 19, it can be seen that, upon looping over the user's head, the user 2 proceeds to grasp the closed loop band. The user then twists the closed loop band to form a FIG. 8 as shown in FIG. 20 before proceeding to loop the double loops over the user's head as shown in FIG. 21.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A nursing cover adapted for use by a user, said nursing cover comprising:

a front portion, and a top periphery defining a top opening through which the user is allowed to penetrate; said front portion having a first side, a second side and a center portion; and a first flexible boning support disposed at said top periphery on said first side extending downward from the first side toward the center portion of said front portion and extending downward from said center portion toward said second side of the front portion and terminating at said second side; and a second flexible boning support disposed at said top periphery on said second side extending downward from said second side toward the center portion of said front portion, said second flexible boning support terminating at the center portion of said front portion;

said first flexible boning support and said second flexible boning support cooperate to outline a top opening cut angle at the center portion of the front panel to form a front vertex;

a third flexible boning support spanning substantially from said front vertex at said center portion downward to said first side of the front portion, said third flexible boning support being below said first flexible boning support on said first side of the front portion, wherein said third flexible boning support and said first flexible boning support substantially meet at the front vertex at said center portion of said front portion; and a fourth flexible boning support spanning from said first side to said second side below said third flexible boning support on said front portion, wherein said first, second, third and fourth flexible boning supports cooperate to provide structural integrity to said front portion while the user nurses the infant underneath the front portion to prevent the nursing cover from interfering with the infant being nursed by the user, to allow better circulation of airflow for the infant underneath the nursing cover and to provide a better line of sight for the user to view the infant underneath the nursing cover via said front vertex.

2. The nursing cover according to claim 1, wherein said nursing cover is configured to be converted into and utilized as an infinity scarf.

3. The nursing cover according to claim 2, wherein said first, second, third and fourth flexible boning supports are capable of being removed.

4. The nursing cover according to claim 3, wherein the infinity scarf is configured to be worn as a single loop or a double loop for convenience and portable storage with or without said first, second, third and fourth flexible boning supports.

5. The nursing cover according to claim 1, wherein the front portion is configured for covering the user's entire torso, covering the user's left shoulder while tucked underneath the user's right armpit, covering the user's right shoulder while tucked underneath the user's left armpit, draping over the user's elbow, looping around the user's arm or resting on the user's shoulders.

6. The nursing cover according to claim 1, wherein the front portion is made of cotton, jersey-knit fabric, woven fabric, muslin, a colored material that is non-see-through or a colored material that is see-through.

7. The nursing cover according to claim 1, wherein said nursing cover further comprises a pair of complementary securing means disposed on said top periphery such that when said pair of complementary securing means are coupled, said top opening is restricted, the pair of complementary means for securing said nursing cover around the user.

8. The nursing cover according to claim 1, further comprising a first channel, a second channel, a third channel and a fourth channel disposed on said front portion, wherein said first channel, second channel, third channel and fourth channel are configured to removably receive said first flexible boning support, said second flexible boning support, said third flexible boning support and said fourth flexible boning support respectively.

* * * * *